US010119434B2

(12) United States Patent
Zschieschang et al.

(10) Patent No.: US 10,119,434 B2
(45) Date of Patent: Nov. 6, 2018

(54) CAMSHAFT ADJUSTING DEVICE

(71) Applicant: Schaeffler Technologies AG & Co. KG, Herzogenaurach (DE)

(72) Inventors: Torsten Zschieschang, Hagenbuechach (DE); Steffen Raecklebe, Obermichelbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 33 days.

(21) Appl. No.: 15/126,956

(22) PCT Filed: Jan. 14, 2015

(86) PCT No.: PCT/DE2015/200002
§ 371 (c)(1),
(2) Date: Sep. 16, 2016

(87) PCT Pub. No.: WO2015/144142
PCT Pub. Date: Oct. 1, 2015

(65) Prior Publication Data

US 2017/0130619 A1 May 11, 2017

(30) Foreign Application Priority Data

Mar. 26, 2014 (DE) ..... 10 2014 205 568

(51) Int. Cl.
*F01L 1/34* (2006.01)
*F01L 1/344* (2006.01)

(52) U.S. Cl.
CPC ... *F01L 1/3442* (2013.01); *F01L 2001/34453* (2013.01)

(58) Field of Classification Search
CPC ..... F01L 1/3442; F01L 2001/34453
(Continued)

(56) References Cited

U.S. PATENT DOCUMENTS 6,968,818 B2 11/2005 Plank et al.
8,631,774 B2 * 1/2014 Fujiwaki ..... F01L 1/3442 123/90.15
(Continued)

FOREIGN PATENT DOCUMENTS

CN 103109050 A 5/2013
CN 103485853 1/2014
(Continued)

*Primary Examiner* — Ching Chang
(74) *Attorney, Agent, or Firm* — Davidson, Davidson & Kappel, LLC

(57) ABSTRACT

A camshaft adjusting device, including a vane cell adjuster having a stator connectable to a crankshaft and a rotor, which is rotatably supported in the stator and connectable to a camshaft. Webs on the stator, divide an annular space between the stator and the rotor into pressure chambers, wherein the rotor has a rotor hub and vanes extending radially outward from the rotor hub, which vanes divide the pressure chambers into two groups of working chambers having a different acting direction, into each of which working chambers pressure medium flowing in or out in a pressure-medium circuit can be admitted, and a central locking device for locking the rotor in relation to the stator. The central locking device has two spring-loaded locking pins in an accommodating space, and lockable in a locking slot secured to the stator and lock in the locking slot when the rotor rotates from the direction of an "early" or "late" stop position into the locking position from different directions, wherein the locking pin forms a valve device together with the particular accommodating space, wherein the locking pin is a step pin.

8 Claims, 6 Drawing Sheets

(58) Field of Classification Search
USPC ..... 123/90.15, 90.17
See application file for complete search history.

(56) References Cited

U.S. PATENT DOCUMENTS

| | | | |
|---|---|---|---|
| 8,820,280 | B2 | 9/2014 | Smith |
| 9,004,030 | B2 | 4/2015 | Watanabe et al. |
| 2003/0121486 | A1 | 7/2003 | Komazawa et al. |
| 2008/0022953 | A1 | 1/2008 | Kanada et al. |
| 2011/0067657 | A1 | 3/2011 | Strauss |
| 2012/0073531 | A1 | 3/2012 | Urushihata |
| 2013/0112161 | A1 | 5/2013 | Fujiwaki et al. |

FOREIGN PATENT DOCUMENTS

| | | | |
|---|---|---|---|
| DE | 102008011915 | A1 | 9/2009 |
| DE | 102008011916 | A1 | 9/2009 |
| DE | 112011102351 | T5 | 4/2013 |
| DE | 102013207616 | A1 | 10/2014 |
| EP | 1452700 | | 9/2004 |
| EP | 2161418 | | 3/2010 |
| EP | 2397661 | | 12/2011 |
| JP | 2000345815 | A | 12/2000 |
| JP | 2011163270 | | 8/2011 |
| JP | 2012072674 | | 4/2012 |
| WO | WO03100222 | | 12/2003 |
| WO | WO2006011648 | | 2/2006 |

* cited by examiner

CAMSHAFT ADJUSTING DEVICE

The present invention relates to a camshaft adjusting.

Camshaft adjusting devices are generally used in valve trains of internal combustion engines in order to alter the valve opening and closing times, as a result of which the consumption values of the internal combustion engine and the operating behavior may generally be improved.

BACKGROUND

One specific embodiment of the camshaft adjusting device proven in practice includes a vane cell adjuster with a stator and a rotor, which delimit an annular space, which is subdivided by projections and vanes into multiple working chambers. The working chambers may be selectively acted upon by a pressure medium, which is fed in a pressure medium circuit via a pressure medium pump from a pressure medium reservoir into the working chambers on one side of the vanes of the rotor and is fed from the working chambers on the respective other side of the vanes back to the pressure medium reservoir. The working chambers, the volume of which is increased in the process, exhibit an operating direction, which is opposite the operating direction of the working chambers, the volume of which is reduced. Accordingly, the operating direction means that a pressure medium acting upon each group of working chambers causes the rotor to rotate either clockwise or counterclockwise relative to the stator. The pressure medium flow, and therefore the adjusting movement, is controlled, for example, with the aid of a central valve having a complex structure of flow-through openings and control edges and a valve body displaceable in the central valve, which closes or unblocks the flow-through openings as a function of its position.

One problem with such camshaft adjusting devices is that in a start phase they are not yet completely filled with pressure medium and may even be run dry, so that the rotor may carry out uncontrolled movements relative to the stator due to the alternating torques exerted by the camshaft, which may result in increased wear and an undesirable noise generation. To avoid this problem, it is known to provide a locking device between the rotor and the stator, which locks the rotor in a rotation angle position relative to the stator favorable for starting when the internal combustion engine is turned off. In exceptional cases, however, for example, when the internal combustion engine stalls, it is possible that the locking device does not lock the rotor as intended, and it is necessary to operate the camshaft adjuster in the subsequent start phase with an unlocked rotor. However, since some internal combustion engines have a very poor start behavior when the rotor is not locked in the center position, the rotor must then be automatically rotated and locked in the center locking position in the start phase.

Such an automatic rotation and locking of the rotor relative to the stator is known, for example, from DE 10 2008 011 915 A1 and from DE 10 2008 011 916 A1. The locking devices described in both publications include a plurality of spring-loaded locking pins, which lock successively in locking slots provided on the sealing cover or on the stator when the rotor is rotated and, in the process, allow the rotor in each case to rotate in the direction of the center locking position before reaching the center locking position, but which block a rotation of the rotor in the opposite direction. After the internal combustion engine is warmed up and/or the camshaft adjuster is filled completely with pressure medium, the locking pins, activated by the pressure medium, are forced out of the locking slots so that the rotor may be subsequently rotated as intended for adjusting the rotation angle position of the camshaft relative to the stator.

SUMMARY OF THE INVENTION

One disadvantage of this approach is that the rotor can be locked only with multiple successively locking pins, which results in higher costs. In addition, the locking process presupposes that the locking pins lock successively in a functionally reliable manner. If one of the locking pins fails to lock, the locking process may be interrupted, since the rotor is therefore not locked on one side in the intermediate position and may rotate back.

It is an object of the present invention to provide a camshaft adjuster which includes a functionally reliable and cost-effective center locking of the rotor.

According to the basic concept of the present invention, it is provided that the locking pin forms a valve pin, the valve pin being a step pin. By using a valve pin as a locking pin, the locking pin, in addition to the locking function, may also assume the function of a valve. The valve pin is particularly advantageously formed as a step pin. The step pin includes annular grooves used to unblock a fluidic connection between pressure medium lines, which adjoin an accommodating space of the valve pin. Provided on the step pin are at least two projections, with which the adjoining pressure medium lines may be fluidically sealed off from the accommodating space. In this way, the pressure medium lines fluidically connected to the accommodating space may be fluidically interconnected in various combinations with one another as a function of the axial position of the locking pin.

It is further advantageous if in a first switching position the fluidic connection between the inflow pressure medium line and the working chamber occurs exclusively via at least one check valve, and in a second switching position the valve device free-flowingly connects at least one inflow pressure medium line with a working chamber. In this way, a kind of free run may be implemented by the fluidic intermediate connection of the check valve in order to lock the rotor in a center locking position with respect to the rotor.

It is further provided that the check valve is situated in such a way that a flow through the check valve is possible only in the case of a through-flow from the inflow pressure medium line in the direction of the pressure medium chamber. As a result of this operating direction of the check valve, the pressure medium is able to flow from the inflow pressure medium line via the outflow pressure medium line only in the direction of the working chamber. A backflow of the pressure medium from the working chamber is thereby avoided, so that the volume of the working chamber in one switching position may only increase. In this way, the rotor may rotate in one direction relative to the stator as a result of the operating alternating torques (camshaft torque actuated) in the start phase, whereas the rotational movement in the respective opposite direction is blocked in each case by the check valve. As a result, the check valve forms the free run, which uses the alternating torque exerted to rotate the rotor automatically in pulses from the direction of the stop position in the direction of the center locking position. It is particularly important in this case that the remaining working chambers are short-circuited during the inflow of the pressure medium, so that the pressure medium contained therein is able to flow past the other working chambers and not inhibit the rotational movement.

It is further advantageous if the valve device is fluidically connectable to the working chamber via a first and/or a second outflow pressure medium line. A fluidic connection may thereby be established between the accommodating space and the working chamber via the first or the second pressure medium line. Alternatively, the working chamber may be connected to the accommodating space via the first and the second pressure medium line, and in this way the flow volume of the pressure medium is increased by the fluidic parallel connection.

In a first switching position of the valve device, the inflow pressure medium line is preferably connected only to a second outflow pressure medium line, and in a second switching position, the first outflow pressure medium line and one second outflow pressure medium line are fluidically connected to the inflow pressure medium line, the first and the second outflow pressure medium lines being fluidically connected in parallel. Thus, for example, a fluidic connection between the accommodating space and the working chamber may be established via a check valve regardless of the switching position of the valve pin. In a second switching position, the accommodating space, in addition to the fluidic connection, is fluidically freely connected to the working chamber via the check valve. A freely flowable pressure medium line in this context is understood to mean a pressure medium line, through which pressure medium may flow unhindered or essentially unhindered in both flow directions; accordingly, a pressure medium line having a check valve is not free-flowing.

The check valve is further preferably provided in the second outflow pressure medium line. In this way, the valve device is connected to the working chamber via two pressure medium lines fluidically connected in parallel, one outflow pressure medium line enabling a fluidically free connection and the flow occurring in the other outflow pressure medium line via a check valve.

In one preferred specific embodiment of the present invention, the check valve is formed by a band check valve. The band check valve offers a simple and compact option for integrating the check valve into the valve pin. In addition, a certain axial extension may be gained by the band check valve, so that the inflow pressure medium line may be fluidically connected to the second outflow pressure medium line via the check valve regardless of the switching position of the valve pin.

It is further advantageous if the band check valve is situated on the valve pin. The band check valve, with its circular shape, may be easily integrated between the projections of the valve pin. The accommodating space of the valve pin is cylindrically shaped, as a result of which the annular band check valve may be easily moved with the valve pin in the accommodating space in the axial direction.

It is further advantageous if the band check valve in the first switching position and in the second switching position is fluidically connected to the inflow pressure medium line and to the first and second outflow pressure medium lines. Thus, in a first switching position, a fluidic connection is established via the check valve between the inflow pressure medium line and the second outflow pressure medium line, so that the pressure medium is able to flow only in the direction of the working chamber. In addition to the fluidic connection in the switching position, a fluidically free connection is established in the second switching position between the inflow pressure medium line and the first outflow pressure medium line. In this way, the pressure medium may flow in parallel into the working chamber via the first and second outflow pressure medium lines. Once the pressure at the C-port drops below a certain level, the valve pin is moved by the spring force into the first switching position. The backflow of the pressure medium from the working chamber via the first outflow pressure medium line is now no longer possible. A backflow of the pressure medium via the second outflow pressure medium line is blocked by the band check valve. If, however, a residual pressure is present in the inflow pressure medium line, the pressure medium may still flow from the inflow pressure medium line into the second outflow pressure medium line.

It is further provided that one band of the band check valve is pre-stressed radially outwardly. This means that the band has a tendency to arch outwardly, whereby it is compressible as a result of an application of pressure medium, and the through-flow is prevented in the absence of an application of pressure medium. During the application of pressure medium, the band consequently reduces its radius and unblocks a fluidic through-flow. In this specific embodiment, the band check valve may be more easily integrated into the valve pin. In principle, however, it is also possible for the band to be pre-stressed inwardly.

BRIEF DESCRIPTION OF THE DRAWINGS

The present invention is described in greater detail below with reference to a preferred exemplary embodiment. In the individual figures, in particular.

DETAILED DESCRIPTION

Figure 1:
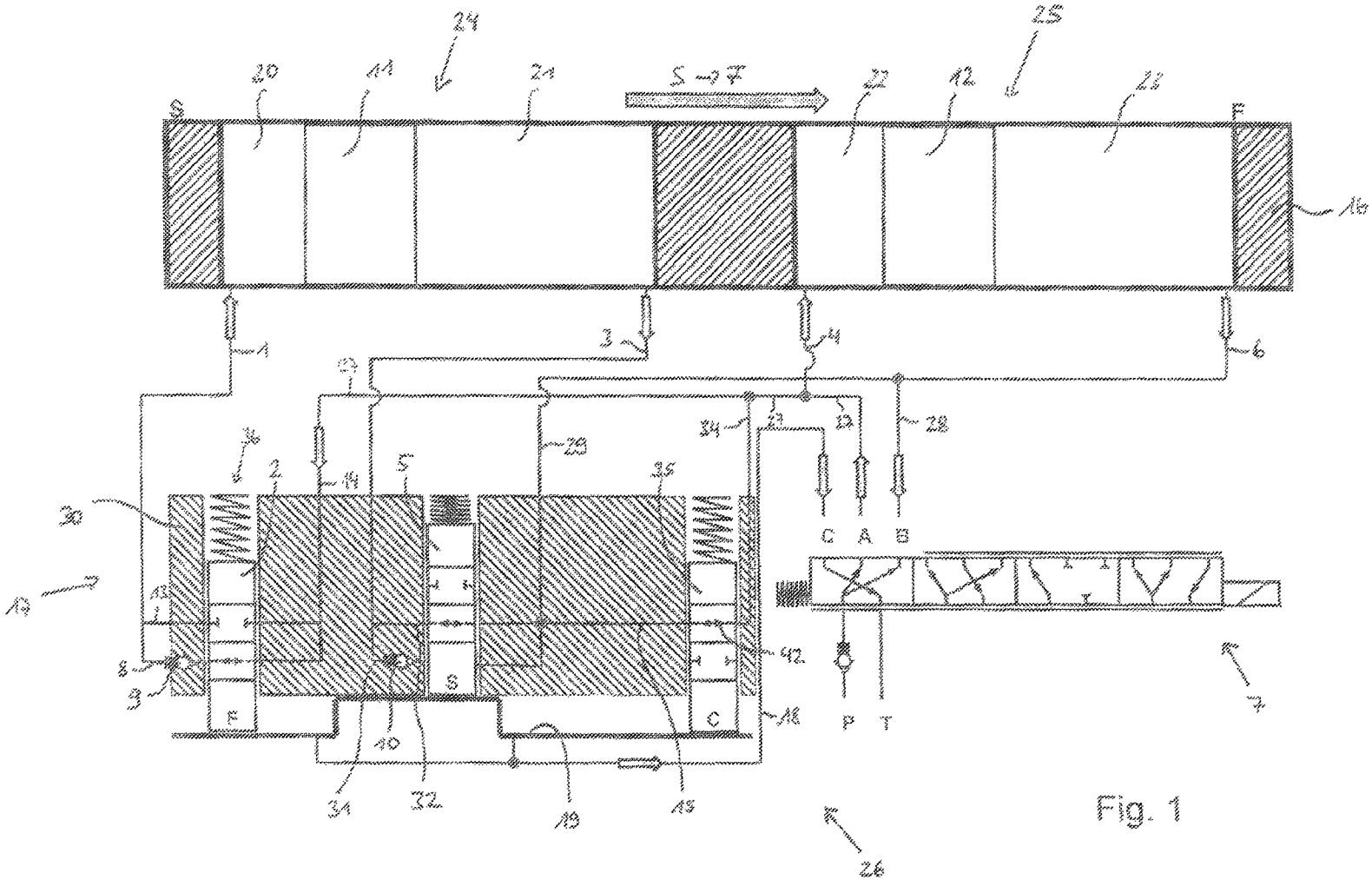
FIG. 1 schematically shows a representation of a camshaft adjusting device according to the present invention with a circuit diagram of a pressure medium circuit during an adjusting movement of the rotor from the direction "late" into the center locking position.

A camshaft adjusting device is apparent in FIG. 1, having a known basic construction with a schematically depicted vane cell adjuster as the basic component, which includes a stator 16 drivable by a crankshaft not depicted and a rotor 17 rotatably fixedly connectable to a camshaft also not depicted having multiple vanes 11 and 12 extending radially outwardly therefrom. In the upper development drawing, the vane cell adjuster is apparent, whereas a detail of rotor 17 having a center locking device 26 is apparent at the bottom left and a switching device in the form of a selector switch valve 7 for controlling the pressure medium flow is apparent at the bottom right. Selector switch valve 7 includes an A-port, B-port and C-port, to which pressure medium lines 18, 27 and 28 are fluidically attached. In addition, selector switch valve 7 is fluidically connected to a pressure medium reservoir T and to a pressure medium pump P which, during an actuation of the camshaft adjusting device, conveys the pressure medium, once it is returned, again from pressure medium reservoir T in a pressure medium circuit.

A pressure medium circuit is also apparent having a plurality of pressure medium lines 1, 3, 4, 6, 8, 13, 14, 14*a*, 14*b*, 15, 18, 27, 28, 29, 31, 32, 34 and 42, which are selectively fluidically connectable to pressure medium pump P or pressure medium reservoir T via selector switch valve 7.

Stator 16 includes a plurality of stator webs, which subdivide an annular space between stator 16 and rotor 17 into pressure chambers 24 and 25. Pressure chambers 24 and 25, in turn, are subdivided by vanes 11 and 12 of rotor 17 into working chambers 20, 21, 22 and 23, into which pressure medium lines 1, 3, 4 and 6 open. Center locking device 26 includes two locking pins 2 and 5, which are used for locking rotor 17 with respect to stator 16 in a locking slot 19 secured to the stator. Locking slot 19 may be situated in a sealing cover securely screwed to stator 16.

In principle, the rotation angle of the camshaft relative to the crankshaft during normal operation is adjusted in the direction "late," for example, by applying pressure medium to working chambers 21 and 23 and thereby increasing their volume, while at the same time forcing the pressure medium from working chambers 20 and 22 and reducing their volume. The stop position "early" is marked in the depictions with an F, and the stop position "late" is marked with an S. Working chambers 20, 21, 22 and 23, the volume of which is increased each time in groups during this adjusting movement, are referred to within the meaning of the present invention as working chambers 20, 21, 22 and 23 of one operating direction, while working chambers 20, 21, 22 and 23, the volume of which at the same time decreases, are referred to as working chambers 20, 21, 22 and 23 of the opposite operating direction. The volume change of working chambers 20, 21, 22 and 23 then result in rotor 17 with vanes 11 and 12 rotating with respect to stator 16. In the upper development drawing of stator 16, the volume of working chambers 21 and 23 is increased by an application of pressure medium via the B-port of selector switch valve 7, whereas the volume of working chambers 20 and 22 at the same time is reduced by the backflow of the pressure medium via the A-port of selector switch valve 7. This volume change results in a rotation of rotor 17 with respect to stator 16 from the direction "early" to "late."

A valve function pin 35 is also provided, which is also linearly displaceable and spring-loaded. Valve function pin 35 is spring-loaded in the direction of the engagement position in locking slots 19 and is situated in rotor 17 in such a way that it does not hinder the rotational movement of rotor 17 with respect to stator 16 in any position of rotor 17. Valve function pin 35 is moved practically only concurrently. To enable the adjustment of rotor 17 with respect to stator 16, center locking device 26 is first released by applying pressure medium via pressure medium pump P to locking slot 19 via pressure medium line 18 from the C-port of selector switch valve 7. Due to the application of pressure medium to locking slot 19, locking pins 2 and 5, as well as valve function pin 35, are forced out of locking slot 19, so that rotor 17 may subsequently rotate freely with respect to stator 16.

In FIG. 1, it is apparent that a check valve 9 and 10, respectively, is situated in a rotor hub 30 of rotor 17 in spatial proximity to locking pins 2 and 5. However, this depiction is understood to be schematic, so that in an alternative specific embodiment, check valves 9 and 10 may also be situated in locking pins 2 and 5.

Locking pins 2 and 5 are spring-loaded in the direction of a first switching position, in which they engage in locking slots 19 as is apparent based on locking pin 2 in FIG. 1. In this case, second outflow pressure medium line 8 is situated with check valve 9 situated therein in rotor hub 30 in such a way that in the first position of locking pin 2, it fluidically connects inflow pressure medium line 14 to second outflow pressure medium line 8 which, in turn, opens into working chamber 20 via first pressure medium line 1. Pressure medium line 27 is fluidically connected to pressure medium line 4 opening into working chamber 22 and, at the same time, opens into the A-port of selector valve 7. Check valve 9 is aligned in such a way that an inflow of the pressure medium into working chamber 20 is possible, whereas an outflow of pressure medium from working chamber 20 is prevented. Rotor 17 in this position is not locked once the internal combustion engine is turned off and is rotated in the direction of the stop position "late," which may occur, for example, in the event of a stall of the internal combustion engine. Locking pin 5 does not engage in locking slot 19 and is shifted into a second switching position against the acting spring force, in which freely flowable first outflow pressure medium line 32 is fluidically connected by locking pin 5 in the second switching position to inflow pressure medium line 29. Pressure medium line 29 is fluidically connected to pressure medium line 6 and attached to the B-port of selector switch valve 7 via pressure medium line 28. To enable the free run and, therefore, the movement of the camshaft adjuster into the center locking position, working chambers 20 and 21 of pressure chamber 24, and working chambers 22 and 23 of pressure chamber 25 must be fluidically short-circuited. This occurs via valve function pin 35, which is moved from a first switching position into a second switching position as a result of the application of pressure medium on locking slot 19, and thereby fluidically connecting pressure medium line 15 to pressure medium line 34 via pressure medium line 42. This allows an overflow of the pressure medium between two oppositely functioning working chambers 20, 21, 22 and 23, which takes place as a function of the relative angle of stator 16 with respect to rotor 17 via a check valve 9 and 10 or via freely flowable pressure medium lines 13 and 32.

During the start phase of the internal combustion engine, alternating torques act on the camshaft and, therefore, on rotor 17. The torques acting on rotor 17 in the direction of the arrow result in the pressure medium being forced out of working chambers 21 and 23 via pressure medium lines 3 and 6, see FIG. 1. With a movement of rotor 17 from the direction "late" into the center locking position, locking pin 5 is in the second switching position, as a result of which first outflow pressure medium line 32 is fluidically connected to inflow pressure medium line 29. In this way, the pressure medium may flow from pressure medium line 3 via pressure medium lines 32, 15, 42, 34, 27, 14, 8 and 1 into working chamber 20; thus, the flow takes place via check valve 9. In addition, the pressure medium may flow from working chamber 21 also via pressure medium lines 3, 32, 15, 42, 34, 27 and 4 into working chamber 22. The pressure medium from working chamber 23 flows via pressure medium lines 6, 29, 15, 42, 34, 27, and 4 into working chamber 22, and via pressure medium lines 6, 29, 15, 42, 34, 27, 14, 8 and 1 into working chamber 20; the flow in this case also takes place via check valve 9.

Working chambers 20, 21, 22 and 23 are therefore short-circuited in the direction of the arrow in FIG. 1 when torques occur. In the event, however, that torques act counter to the direction of the arrow, the pressure medium is unable to exit working chamber 20 due to the alignment of check valve 9, rotor 17 being supported in this rotational direction via the pressure medium at check valve 9. A kind of free run is practically implemented as a result, by which rotor 17 is rotated automatically in pulses into the center locking position while utilizing the acting camshaft alternating torques, until locking pin 2 abuts the side of a stop of locking slot 19 and locking pin 5 is also locked in locking slot 19 supported by spring force.

Figure 2:
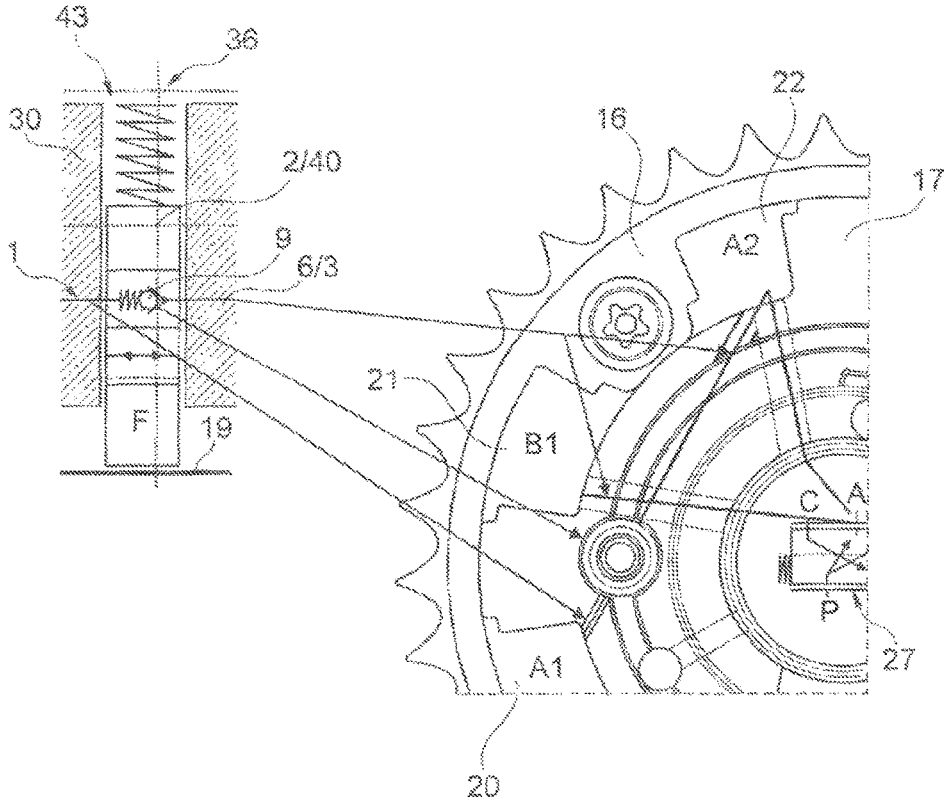
FIG. 2 shows a sectional representation of a camshaft adjusting device, from which the arrangement of the valve device in the rotor and the course of the pressure medium lines is discernible.

FIG. 2 shows a sectional representation of a camshaft adjusting device according to the present invention. A first valve device 36 is apparent, which is formed essentially by an accommodating space 43 and locking pin 2 guided therein. Locking pin 2 in this case forms a valve pin 40. Valve device 36 is situated in such a way that the axial movement of locking pin 2 occurs in the direction of the rotational axis of the camshaft adjusting device, the rotational axis of the camshaft adjusting device extending perpendicular to the drawing plane. First valve device 36 shown on the left side schematically represents the two possible switching positions, the flow of pressure medium in the first switching position occurring via check valve 9. It is schematically shown that in the second switching position of first valve device 36, pressure medium line 1 is fluidically freely connectable to pressure medium line 3 and 6, and in a first switching position, the fluidic connection between pressure medium line 1 and pressure medium line 3 and 6 is established via check valve 9. It is also apparent in FIG. 1 that working chambers 20 and 22, which have the same operating direction, are fluidically connectable to pressure medium pump P via selector switch valve 27.

Specific embodiments for first valve device 36 are described below. These specific embodiments may be applied analogously to a second valve device 37, which is formed essentially by an accommodating space 44 and locking pin 5 mounted therein.

Figure 3:
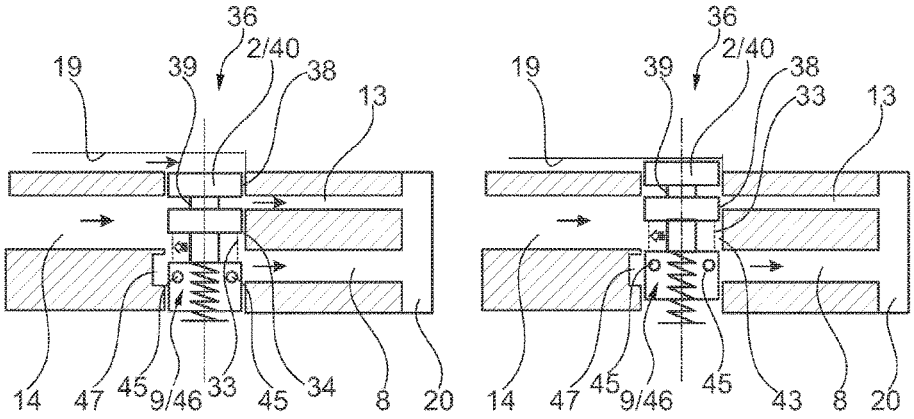
FIG. 3 shows a first specific embodiment of a valve device including a band check valve.

FIG. 3 shows a specific embodiment of first valve device 36, in which check valve 9 is provided in locking pin 2. Valve pin 40 is formed by locking pin 2, valve pin 40 being a stepped pin. Valve pin 40 therefore includes two projections 38 and at least one annular groove 39. The adjoining inflow pressure medium line 14 and first and second outflow pressure medium lines 13 and 8 may be fluidically blocked with respect to accommodating space 43 via projections 38. A fluidic connection to accommodating space 43 is established between the adjoining inflow pressure medium line and first and second outflow pressure medium lines 13 and 8 by annular groove 39. Inflow pressure medium line 14 may be fluidically connected in various combinations to first and second outflow pressure medium lines 13 and 8 as a function of the position of valve pin 40, which thereby also determines the switching position of first valve device 36.

In the specific embodiment from FIG. 3, check valve 9 is formed by a band check valve 46. Band check valve 46 in this case is situated in an annular groove 39 between two projections 38 of valve pin 40. One band 33 is preferably pre-stressed outwardly, i.e., in the case of a flow, band 33 is acted upon radially from the outside by pressure medium and compressed against the pre-stressing force, thereby unblocking a fluidic connection. In the case of a flow in the blocking direction, band 33 is acted upon radially from the inside by pressure medium and thus pressed against an inflow opening in such a way that this opening is fluidically blocked. This ensures that the pressure medium is able to flow from inflow pressure medium line 14 via band check valve 33 into second outflow pressure medium line 8; a backflow of the pressure medium from second outflow pressure medium line 8 into inflow pressure medium line 14 is prevented by band check valve 46. In an alternative specific embodiment, band 33 may also be pre-stressed radially inwardly.

Figure 4:
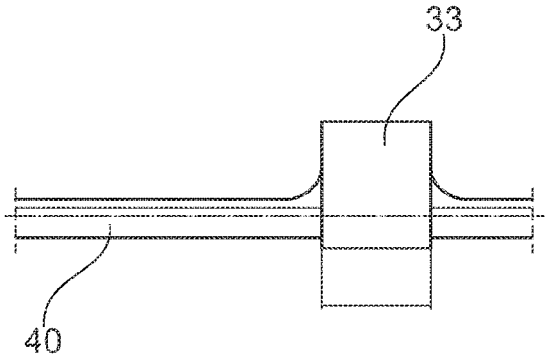
FIG. 4 shows a valve pin including a band of a check valve.

FIG. 4 shows valve pin 40 with band 33. It is apparent that two radii are provided at a transition between valve pin 40 and band 33. A homogeneous transition is thereby achieved between valve pin 40 and band 33. It is also apparent in FIG. 4 that band 33 is firmly connected to valve pin 40 so that in the case of an adjusting movement, valve pin 40 is moved concurrently.

Figure 5:
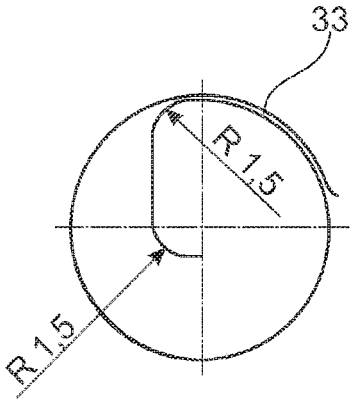
FIG. 5 shows a band of a check valve.

FIG. 5 shows a preferred geometry of band 33 having an enclosure of more than 360°. The band check valve is essentially circular, a partial section 41 of band 33 protruding radially inwardly. In addition, alternative geometries for band 33 are also conceivable.

The left image in FIG. 3 shows first valve device 36 in a second switching position, in which locking slot 19 is acted upon by pressure medium and valve pin 40 is therefore moved against the spring force. In the second switching position, a fluidic connection between inflow pressure medium line 14 and first outflow pressure medium line 13 is established by annular groove 39. A fluidic connection also exists between inflow pressure medium line 14 and second outflow pressure medium line 8. Thus, in the first switching position, the pressure medium may flow from inflow pressure medium line 14 into working chamber 20 via the two outflow pressure medium lines 13 and 8 fluidically connected in parallel. First valve device 36 is depicted on the right side of FIG. 3 in a first switching position. Locking slot 19 is de-pressurized, so that valve pin 40 is pushed by the spring force into the first switching position. In this position of valve pin 40, projection 38 blocks the fluidic connection between accommodating space 43 and first outflow pressure medium line 13. Despite the movement of valve pin 40 into the first switching position, a fluidic connection via band check valve 33 exists between inflow pressure medium line 14 and second outflow pressure medium line 8, i.e., the fluidic connection between inflow pressure medium line 14 and second outflow pressure medium line 8 is independent of the switching position. The axial extension of band check valve 46 is so great that inflow pressure medium line 14 and outflow pressure medium line 8 are connected in both switching positions. Also provided on band check valve 46 are flow openings 45, which are fluidically connected to outflow pressure medium line 8 regardless of the switching position of the valve pin. Flow openings 45 lead into the interior of band check valve 46, so that band 33 is acted upon radially from the inside by pressure medium when pressure medium flows from the direction of second outflow pressure medium line 8; a flow through the check valve is impossible from this direction. If the pressure medium flows from the direction of inflow pressure medium line 14, the band is then compressed and a fluidic connection to flow openings 45 is unblocked. At least one flow opening 45 is provided on band check valve 46, preferably, however, multiple flow openings 45 are provided radially on the outside lateral surface of band check valve 46. Flow openings 45 open into a circumferential annular channel 47, the axial extension of annular channel 48 being so great that the fluidic connection between flow opening 45 and outflow pressure medium line 8 is maintained regardless of the switching position. The fluidic connection between band check valve 46 and inflow pressure medium line 14 is likewise maintained regardless of the switching position of valve pin 40. First valve device 36 in this specific embodiment forms a 3/2-way valve. Alternatively, the specific embodiment with the band check valve 46 may also be implemented via a 4/2-way valve. For this purpose, inflow pressure medium 14 splits into two inflow pressure medium lines 14*a* and 14*b* upstream from accommodating space 43.

Figure 6:
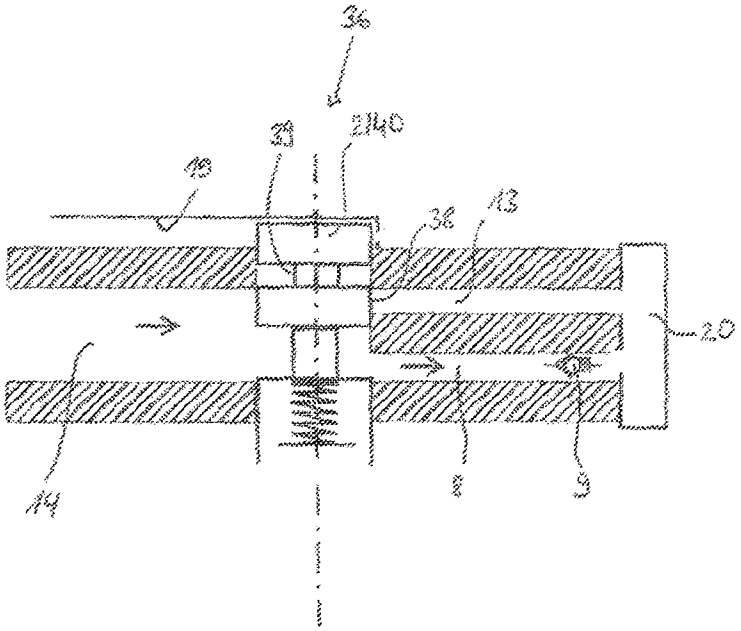
FIG. 6 shows a second specific embodiment of the present invention including a check valve in the second outflow pressure medium line.
Figure 6:
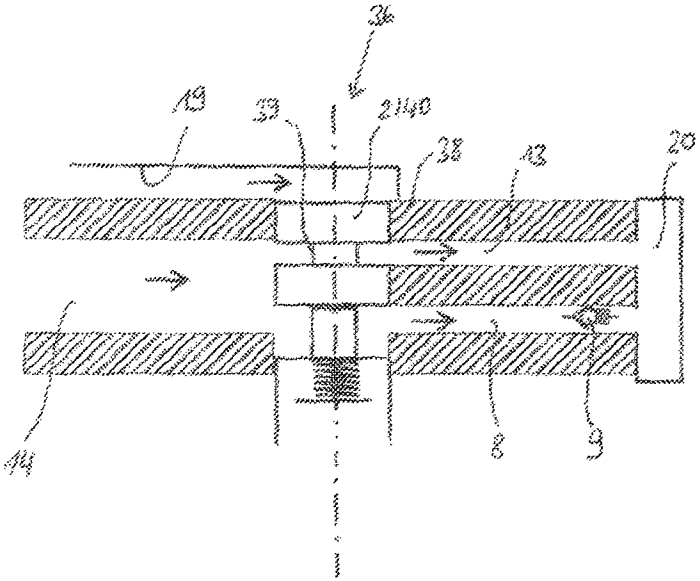

A second specific embodiment of the present invention is shown in FIG. 6. Check valve 9 is situated here in second outflow pressure medium line 8. The left image in FIG. 6 shows valve pin 40 in a second switching position. Inflow pressure medium line 14 in this case is fluidically connected to first outflow pressure medium line 13; at the same time, inflow pressure medium line 14 is connected to second outflow pressure medium line 8, in which check valve 9 is situated. In the right image in FIG. 6, valve pin 40 is in the first switching position, as a result of which projection 38 blocks the fluidic connection between accommodating space 43 and first outflow pressure medium line 13. The fluidic connection between inflow pressure medium line 14 and second outflow pressure medium line 8 exists here as well. Thus, the valve device, as in the first exemplary embodiment in FIG. 3, is formed by a 3/2-way valve. However, check valve 9 in the specific embodiment from FIG. 8 is situated in second outflow pressure medium line 8. Check valve 9 is preferably a ball check valve. Alternatively, other check valves are also conceivable, however.

Figure 7:
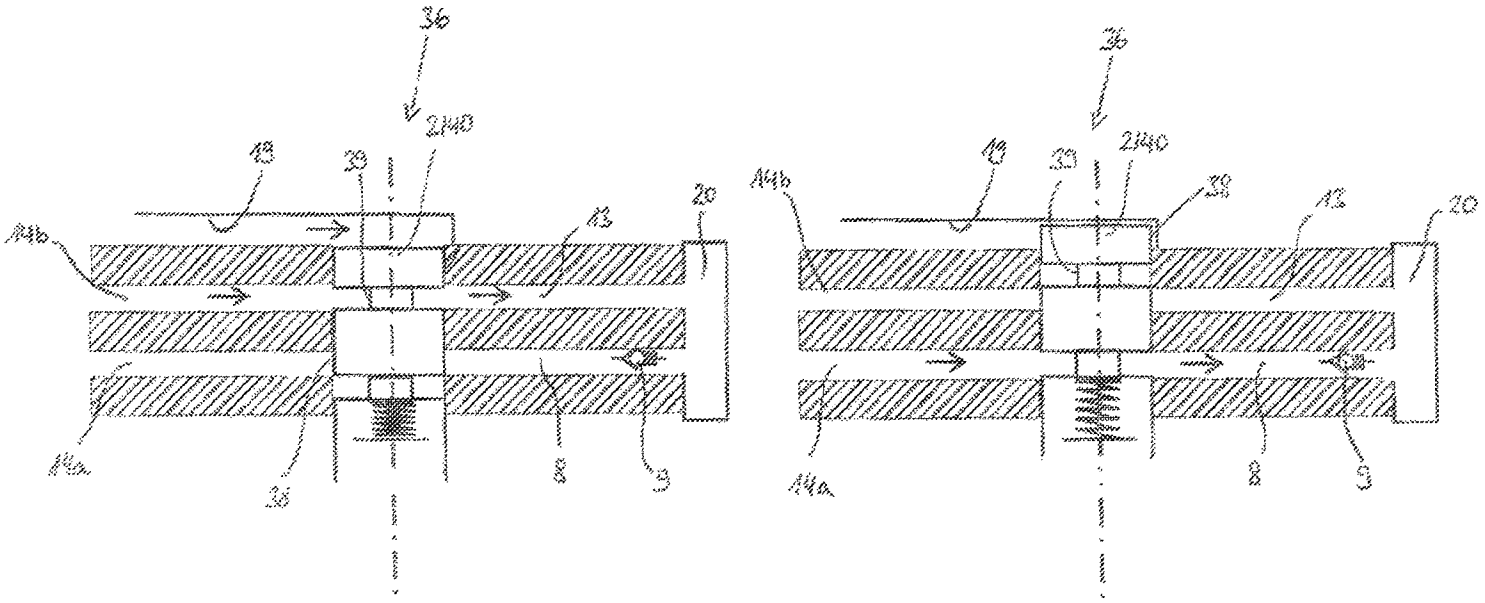
FIG. 7 shows a third specific embodiment of the present invention including a check valve in the second outflow pressure medium line.

FIG. 7 shows a third specific embodiment of the present invention, which differs from the second specific embodiment from FIG. 6 in that inflow pressure medium line 14 splits into two inflow pressure medium lines 14*a* and 14*b* before it opens into accommodating space 43; thus, a 4/2-way valve is formed. In the second switching position (see FIG. 7, left), inflow pressure medium line 14*b* is fluidically connected by groove 39 to first outflow pressure medium line 13. In this switching position, the fluidic connection between inflow pressure medium line 14*a* and second outflow pressure medium line 8 is blocked by projection 38. A fluidic connection exists in the first switching position (see FIG. 7, right) between inflow pressure medium line 14*a* and second outflow pressure medium line 8; the fluidic connection between inflow pressure medium line 14*b* and outflow pressure medium line 13 is fluidically blocked. In this exemplary embodiment, the fluidic connection between inflow pressure medium 14*a* and outflow pressure medium line 8, in which check valve 9 is situated, is a function of the switching position of valve pin 40.

LIST OF REFERENCE NUMERALS

1 pressure medium line
2 locking pin
3 pressure medium line
4 pressure medium line
5 locking pin
6 pressure medium line
7 selector switch valve
8 second outflow pressure medium line
9 check valve
10 check valve
11 vane
12 vane
13 first outflow pressure medium line
14 inflow pressure medium line
14*a* inflow pressure medium line
14*b* inflow pressure medium line
15 pressure medium line
16 stator
17 rotor
18 pressure medium line
19 locking slot
20 working chamber
21 working chamber
22 working chamber
23 working chamber
24 pressure chamber
25 pressure chamber
26 center locking device
27 pressure medium line
28 pressure medium line
29 inflow pressure medium line
30 rotor hub
31 first outflow pressure medium line
32 second outflow pressure medium line
33 band
34 pressure medium line
35 valve function pin
36 first valve device
37 second valve device
38 projection
39 groove
40 valve pin
41 partial section
42 pressure medium line
43 accommodating space
44 accommodating space
45 flow opening
46 band check valve
47 annular channel

What is claimed is:

1. A camshaft adjusting device comprising:

a vane cell adjuster including a stator connectable to a crankshaft of an internal combustion engine; and a rotor rotatably mounted in the stator connectable to a camshaft, multiple webs being provided on the stator, the multiple webs subdividing an annular space between the stator and the rotor into a plurality of pressure chambers, the rotor including a rotor hub and a plurality of vanes extending radially outwardly from the rotor hub, the plurality of vanes subdividing the plurality of pressure chambers into two groups of working chambers having a different operating direction, each of which may be acted upon by pressure medium flowing into or out of a pressure medium circuit, and a central locking device for locking the rotor in at least one locking position relative to the stator, the central locking device including at least two spring-loaded locking pins lockable in a locking slot secured to the stator in an accommodating space, the at least two spring-loaded locking pins locking in the locking slot when the rotor rotates from a direction of an "early" or "late" stop position into the at least one locking position from different directions, one of the at least two spring-loaded locking pins together with the accommodating space forming a valve device, the one of the at least two spring-loaded locking pins forming a valve pin, and the valve pin being a stepped pin, the valve device being fluidically connectable to a respective one of the working chambers via a first or a second outflow pressure medium line, an inflow pressure medium line being connected only to the second outflow pressure medium line in a first switching position of the valve device, and the first outflow pressure medium line and the second outflow pressure medium line being fluidically connected to the inflow pressure medium line in a second switching position.

2. The camshaft adjusting device as recited in claim 1 wherein in a first switching position of the valve device, the inflow pressure medium line is fluidically connected to the respective one of the working chambers exclusively via at least one check valve, and the valve device in a second switching position free flowingly connects at least one inflow pressure medium line to a respective one of the plurality of pressure chambers.

3. The camshaft adjusting device as recited in claim 2 wherein the check valve is situated in such a way that a flow through the check valve is possible only in the case of a through-flow from the inflow pressure medium line in the direction of the respective one of the plurality of pressure chambers.

4. The camshaft adjusting device as recited in claim 2 wherein the check valve is formed by a band check valve.

5. The camshaft adjusting device as recited in claim 4 wherein the band check valve is situated on the valve pin.

6. The camshaft adjusting device as recited in claim 4 wherein the band check valve in the first and in the second switching position is fluidically connected to the inflow pressure medium line and to the second outflow pressure medium line.

7. The camshaft adjusting device as recited in claim 4 wherein a band of the band check valve is pre-stressed radially outwardly.

8. The camshaft adjusting device as recited in claim 1 wherein a check valve is provided in the second outflow pressure medium line.

* * * * *